United States Patent [19]

Bennett et al.

[11] Patent Number: 4,542,550

[45] Date of Patent: Sep. 24, 1985

[54] APPARATUS FOR CLEANING BEACHES

[75] Inventors: John A. Bennett; Scott L. Taylor, both of West Vancouver, Canada

[73] Assignee: Versatech Products Inc., Vancouver, Canada

[21] Appl. No.: 557,362

[22] Filed: Dec. 2, 1983

[30] Foreign Application Priority Data

Feb. 8. 1983 [CA] Canada ..... 421110

[51] Int. Cl.[4] ..... F01H 12/00

[52] U.S. Cl. ..... 15/3

[58] Field of Search ..... 15/98, 99, 119 A, 3, 15/84; 210/241; 56/328 R

[56] References Cited

U.S. PATENT DOCUMENTS 3,789,449 2/1974 MacFarland et al. ..... 15/98
4,173,054 11/1979 Ando ..... 15/98
4,214,336 7/1980 Peterson ..... 15/3

FOREIGN PATENT DOCUMENTS 2234833 1/1974 Fed. Rep. of Germany ..... 15/3

*Primary Examiner*—Edward L. Roberts
*Attorney, Agent, or Firm*—John R. Uren

[57] ABSTRACT

A beach cleaner for removing petroleum deposits. The cleaner comprises a cylinder, an endless belt with a protuberance pattern thereon surrounding the cylinder, a scraper bar mounted adjacent the protuberance pattern and a conveyor mounted adjacent the scraper bar. The cylinder is hollow and can be filled with liquid. The conveyor is driven by a power source and conveys debris sidewise to a collecting device. The beach cleaner is adapted to be mounted to a power unit such as a front end loader.

13 Claims, 6 Drawing Figures

APPARATUS FOR CLEANING BEACHES

INTRODUCTION

This application relates to a beach cleaner and, more particularly, to a beach cleaner used for removing petroleum deposits or petroleum impregnated materials.

BACKGROUND OF THE INVENTION

Beach cleaners used to remove petroleum deposits from beaches are known. In one cleaner, an endless belt is wrapped around a plurality of rollers powered by an engine integral with the cleaner. The belt is provided with protruding metallic spikes which are pressed into the surface of the beach to impale the debris and lift it from the beach surface. This cleaner, however, is disadvantageous in that the metallic spikes are easily damaged, the plurality of rollers are unnecessarily complicated, the belt frequency leaves its track around the rollers and the weight of the engine makes the cleaner unnecessarily heavy and cumbersome.

Various other cleaners lift the top layer of sand from the beach, sift large particles from the sand or flood the top layer of sand with water in an attempt to float the petroleum deposits from the sand. These designs are costly, complicated and again, unduly cumbersome.

SUMMARY OF THE INVENTION

According to the invention, there is disclosed a beach cleaner comprising a chassis operable to be connected to a vehicle, a cylinder rotatably mounted on said chassis, an endless removable belt surrounding said cylinder, a protuberance pattern on the outside of said endless belt, debris scraping removal means mounted in close proximity to the outside diameter of said protuberance pattern on said endless belt, conveyor means mounted adjacent said removal means to receive debris from said removal means and a power source means to drive said conveyor means.

BRIEF DESCRIPTION OF THE SEVERAL VIEWS OF THE DRAWINGS

The invention will now be described, by way of example only, with reference to the accompanying drawings, in which.

DESCRIPTION OF SPECIFIC EMBODIMENT

Figure 1:
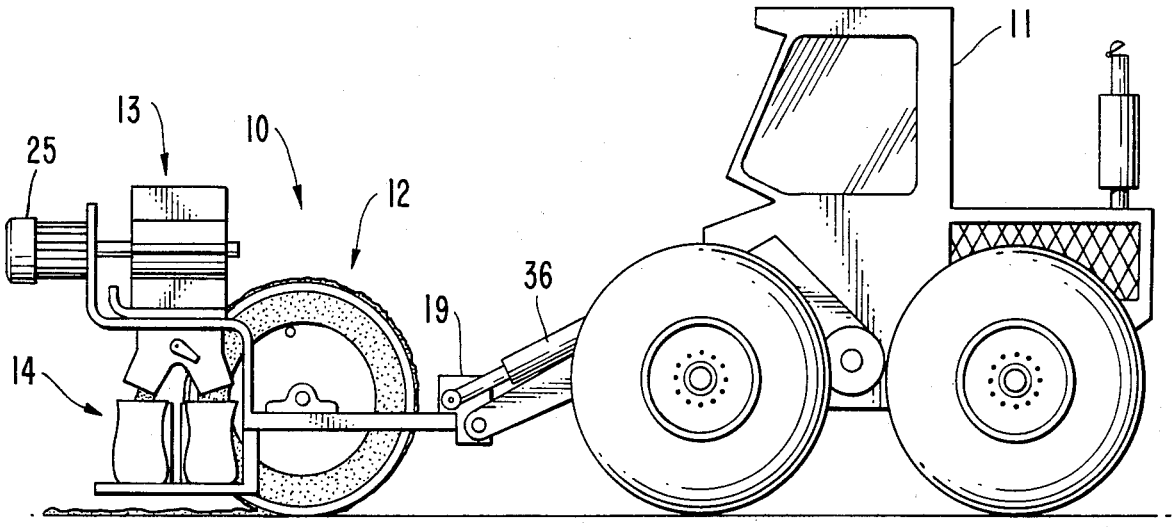
FIG. 1 is a side view of a first embodiment of the beach cleaner according to the invention shown in operating position and attached to a vehicle.

Referring now to the drawings, a beach cleaner is shown generally at 10 in FIG. 1. It is attached to a power unit, namely a vehicle, specifically a front end loader 11. The beach cleaner 10 comprises an adhesion system shown generally at 12, a removal mechanism shown generally at 13 and a collecting device shown generally at 14.

Figure 2:
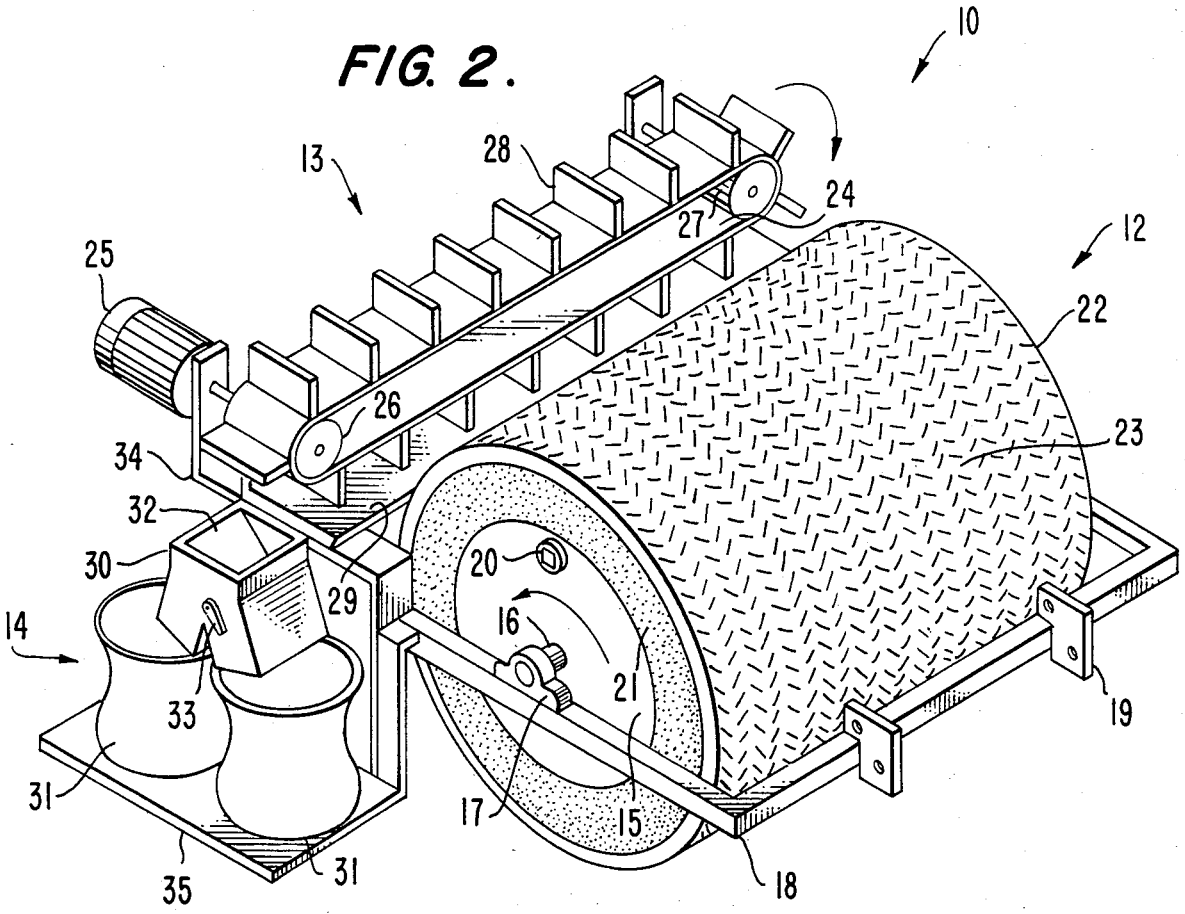
FIG. 2 is a diagrammatic perspective view of the beach cleaner of FIG. 1.

The beach cleaner 10 is shown in greater detail in FIG. 2. The adhesion system 12 includes a hollow cylinder 15 mounted on a horizontal axle 16. Horizontal axle 16 is journalled in respective end bearings 17 (only one of which is shown) mounted to chassis 18. An attachment bracket 19 is rigidly fixed to chassis 18.

An access opening is provided in cylinder 15 for liquid to be added or removed and a removable plug in the form of a threaded insert 20 is used to open and close the opening communicating with the inside of cylinder 15.

An endless resilient belt 21 surrounds the cylinder 15. The resilient belt 21 has cushioning properties and, to that end, foam rubber or foamed polyurethane has been found suitable.

An endless removable belt 22 is mounted around resilient belt 21. Removable belt 22 is a rubber compound type belt and has a raised protuberance pattern 23 on its external surface designed to create petroleum adherence.

The removal mechanism 13 includes a conveyor 24 and a power means, namely a hydraulic motor 25, for the conveyor 24. Conveyor 24 is a flexible endless belt journalled about roller 26 and idler 27. Paddles 28 extend perpendicular to the track of conveyor 24. A scraper beam 29 extends under the conveyor 24 in a direction parallel to the axis of cylinder 15 and in close proximity to the protuberance pattern 23 of belt 22.

The collecting device 14 includes a bifurcated hopper 30 at the end of scraper beam 29 and conveyor 24 and two flexible containers 31 mounted below bifurcated hopper 30. One container 31 is disposed beneath each outlet of the bifurcated hopper 30. An adjustable deflector plate 32 is pivotably mounted within bifurcated hopper 30 to pivot under the influence of adjusting handle 33. The bifurcated hopper 30 and flexible containers 31 are mounted on frame extensions 34, 35 respectively.

OPERATION

In operation, the beach cleaner 10 is initially attached to front end loader 11 by attachment bracket 19. Since the loader 11 has a four bar type linkage 36 attached to bracket 19, the beach cleaner 10 may be raised or lowered as desired in the same orientation as when in its operating position.

The beach cleaner 10 is lowered to its operating position on the beach, the operation of hydraulic motor 25 is commenced and the loader 11 with beach cleaner 10 attached thereto proceeds leftwardly as viewed in FIG. 1.

Figure 3:
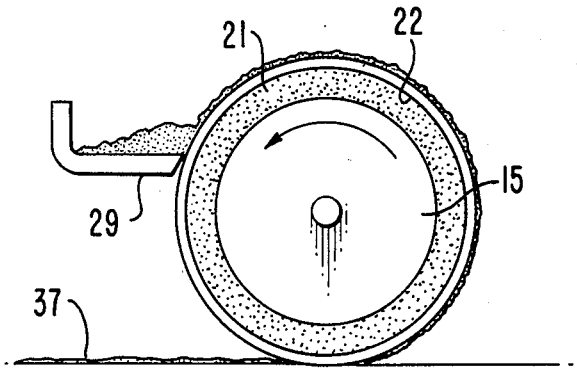
FIG. 3 is a partial side view of the beach cleaner of FIG. 1 in operation.

Referring now to FIG. 3, the petroleum deposits 37 adheres to the removable belt 22 and the protuberance pattern 23 thereon and rotates with cylinder 15 until it is removed by scraper beam 29 as depicted. Paddles 28 (FIG. 2) on conveyor 24 move the petroleum deposits along scraper beam 29 to a predetermined disposal location, specifically, to a bifurcated hopper 30 located at one end of the conveyor 24. The adjusting handle 33 of bifurcated hopper 30 is rotated to direct the adjustable deflector plate 32 such that the petroleum deposits and other debris fall into either of the flexible containers 31 as desired. Flexible containers 31 are removable from frame extension 35 when full and may be replaced.

The pressure of cylinder 15 on the beach may be adjusted by adding or removing liquid from the cylinder 15 by removing threaded insert 20 from the access opening in cylinder 15. Similarly, the speed of conveyor 24 may be increased or decreased by a suitable adjustment of hydraulic motor 25.

Figure 4:
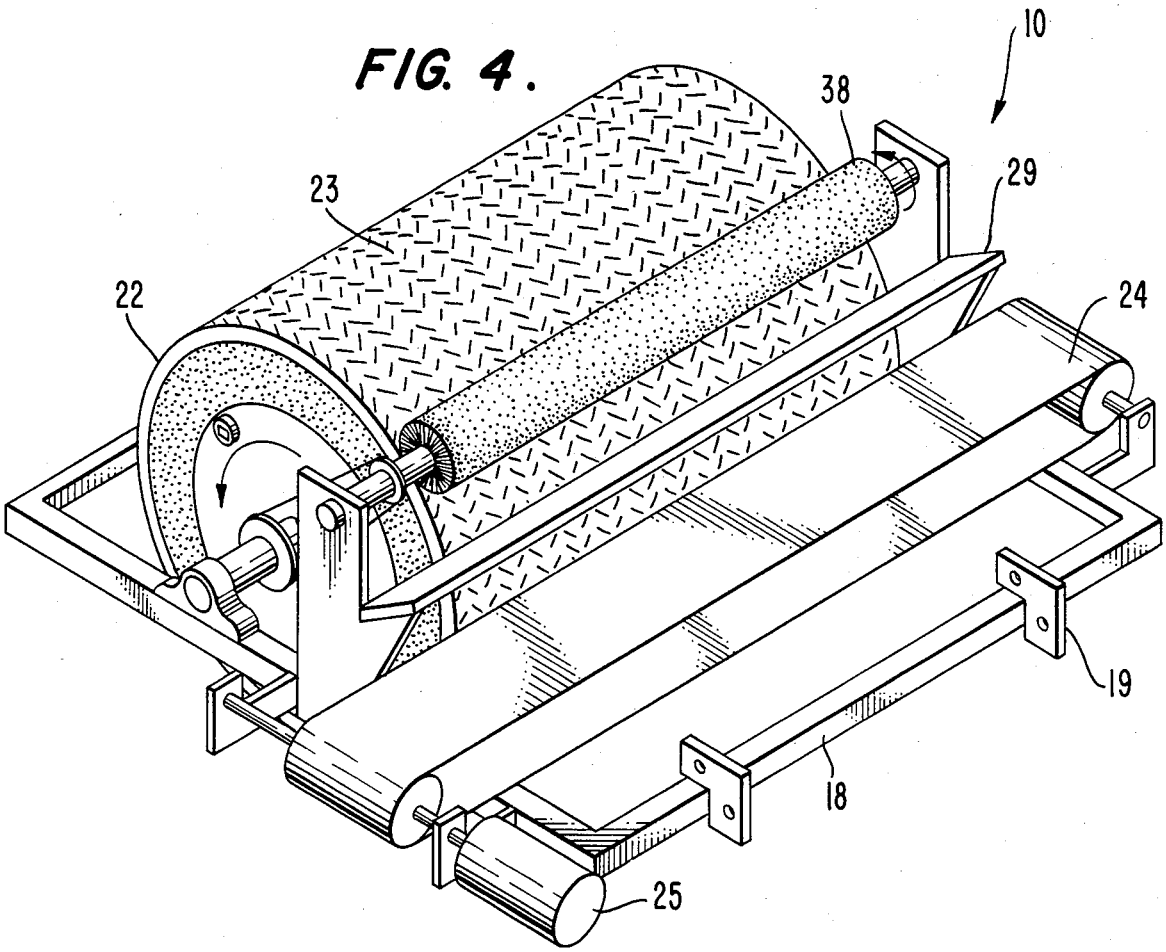
FIG. 4 is a diagrammatic perspective view of a second embodiment of the beach cleaner.
Figure 5:
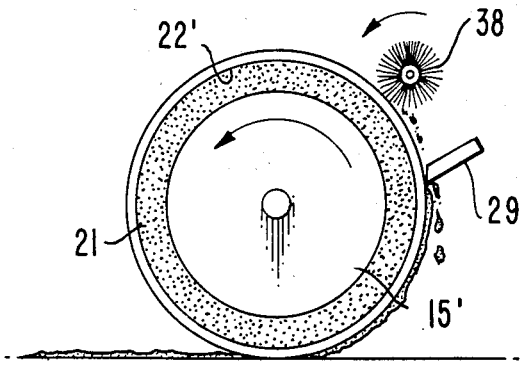
FIG. 5 is a partial side view of the beach cleaner of FIG. 4 in operation.
Figure 6:
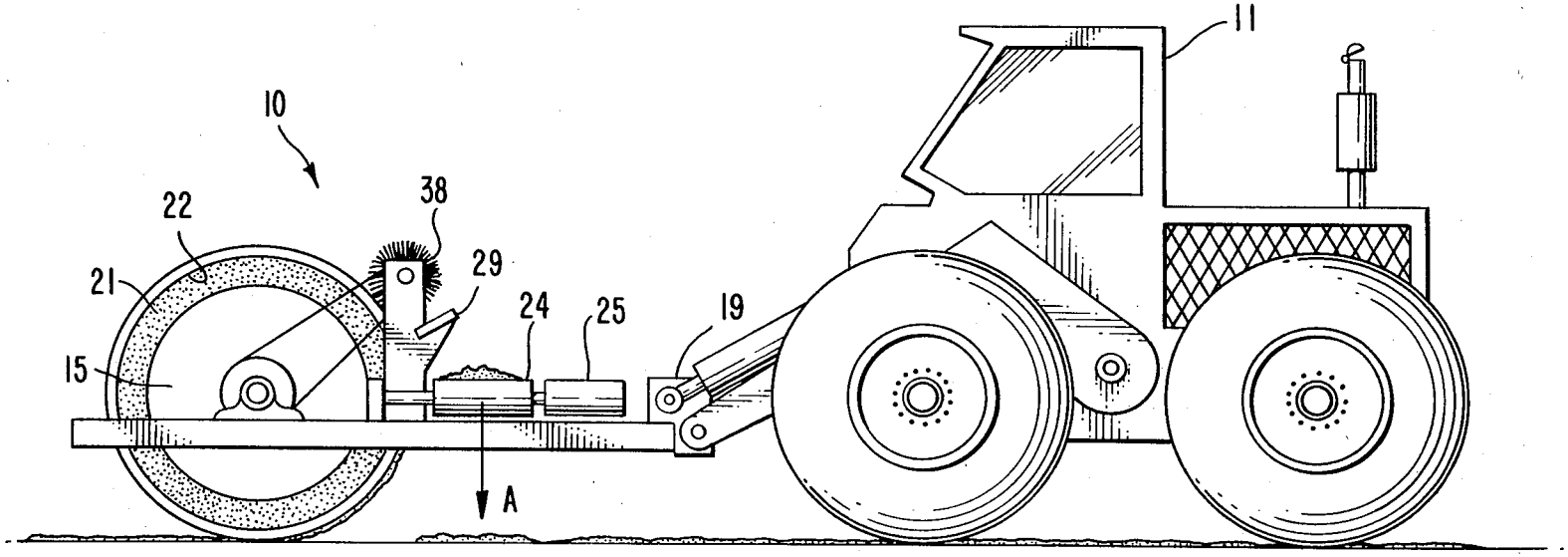
FIG. 6 is a side view of the beach cleaner of FIG. 4 shown in operating position and attached to a vehicle.

A second embodiment according to the invention is depicted in FIG. 4. In this embodiment, like numerals relate to like machine elements as shown in the first embodiment. The main difference is that a brush 38 is provided which rotates in contact with cylinder 15. The brush 38 is used to enhance the removal of the petroleum deposits from belt 22 and protuberance pattern 23 if deposits have passed scraper beam 29 as depicted in FIG. 5. A further difference is that there is no bifurcated hopper 30 or flexible containers 31 provided. Rather, conveyor 24 directs the petroleum deposits to either side of the beach cleaner 10 where they fall to the ground in a windrow as seen by the arrow A in FIG. 6. Subsequently, the windrows can be removed from the beach using an additional operation.

The use of hydraulic motors is desired although not essential. This is so because the operating flexibility of such motors allows effective operation of the beach cleaner 10 under a variety of beach and weather operating conditions. For example, in the embodiment of FIG. 1, the collecting device 14 may be mounted on the side opposite from that shown and the direction of rotation of the hydraulic motor 25 may simply be reversed. Similarly, if it were desired that the windrow of FIG. 6 be deposited on the side opposite from that shown, the hydraulic motor 25 could simply be reversed. The use of hydraulic motor 25 also allows the speed of the conveyor 24 and brush 38 to be increased or decreased as desired depending on the operating conditions. In addition, a chain type conveyor can be substituted for the endless belt conveyor 24.

Other modifications in the apparatus may be made and while specific embodiments of the invention have been described, it is not intended to limit its scope thereby. Accordingly, the invention should be construed by the accompanying claims.

We claim:

1. A beach cleaner comprising a chassis operable to be connected to a vehicle, a cylinder rotatably mounted on said chassis, an endless removable belt surrounding said cylinder, a protuberance pattern on the outside of said endless belt, debris scraping removal means mounted in close proximity to the outside diameter of said protuberance pattern on said endless belt, conveyor means mounted adjacent said removal means to receive debris from said removal means and a power source means to drive said conveyor means.

2. A beach cleaner as in claim 1 wherein said cylinder has a hollow portion and an access opening thereto, said hollow portion allowing liquid to be added or removed from said cylinder through said access opening.

3. A beach cleaner as in claim 2 wherein said conveyor means is a conveyor mounted to move in a direction generally parallel to the axis of said cylinder and being operable in convey debris to a predetermined disposal location.

4. A beach cleaner as in claim 3 wherein said debris scraping removal means is a scraper beam.

5. A beach cleaner as in claim 4 wherein said chassis is connected to said vehicle by an attachment means, said attachment means comprising a four bar linkage between said chassis and said vehicle, said linkage being operable to allow said chassis to be raised and lowered relative to said vehicle.

6. A beach cleaner as in claim 5 wherein said vehicle is a front end loader.

7. A beach cleaner as in claim 4 and further comprising an endless resilient belt between said cylinder and said endless removable belt.

8. A beach cleaner comprising a chassis operable to be connected to a vehicle, a cylinder rotatably mounted on said chassis, an endless removable belt surrounding the periphery of said cylinder, a protuberance pattern on said endless removable belt, a scraper beam mounted in close proximity to the outside diameter of said protuberance pattern to remove debris therefrom, a conveyor operable to receive said debris and to convey said debris substantially parallel to the direction of the axis of said cylinder and a power source to drive said conveyor.

9. A beach cleaner as in claim 8 wherein said cylinder has a hollow portion and an access opening thereto, said hollow allowing liquid to be added or removed from said cylinder through said access opening.

10. A beach cleaner as in claim 9 and further including a collection device, said device comprising a hopper and at least one container located below said hopper.

11. A beach cleaner as in claim 10 wherein said conveyor is operable to convey debris removed by said scraper beam to said collection device.

12. A beach cleaner as in claim 11 wherein said power source is a hydraulic motor.

13. A beach cleaner as in claim 12 and further comprising a rotatable brush mounted adjacent said protuberance pattern, said brush being operable to contact said protuberance pattern and remove said debris from said cylinder.

* * * * *